US008894048B2

(12) United States Patent
Cai et al.

(10) Patent No.: US 8,894,048 B2
(45) Date of Patent: Nov. 25, 2014

(54) GAS DIFFUSER

(71) Applicant: Dow Global Technologies LLC, Midland, MI (US)

(72) Inventors: Qixiang Cai, Hangzhou (CN); Ning Chai, Lake Jackson, TX (US); Steven J. Gluck, Lake Jackson, TX (US); Billy G. Smith, Brazoria, TX (US); Chengfeng Wang, Huzhou (CN); Quan Yuan, Northbrook, IL (US)

(73) Assignee: Dow Global Technologies LLC, Midland, MI (US)

( * ) Notice: Subject to any disclaimer, the term of this patent is extended or adjusted under 35 U.S.C. 154(b) by 36 days.

(21) Appl. No.: 13/937,241

(22) Filed: Jul. 9, 2013

(65) Prior Publication Data

US 2014/0191424 A1 Jul. 10, 2014

Related U.S. Application Data

(60) Provisional application No. 61/672,309, filed on Jul. 17, 2012.

(51) Int. Cl.
*B01F 3/04* (2006.01)

(52) U.S. Cl.
CPC ..... *B01F 3/04262* (2013.01)
USPC ..... 261/121.1; 261/124

(58) Field of Classification Search
USPC ..... 261/121.1, 122.1, 124; 210/636, 210/321.88, 321.89
See application file for complete search history.

(56) References Cited

U.S. PATENT DOCUMENTS

| | | | | |
|---|---|---|---|---|
| 5,248,424 | A | 9/1993 | Cote et al. | |
| 5,482,625 | A | 1/1996 | Shimizu et al. | |
| 6,328,886 | B1 * | 12/2001 | Miyashita et al. | 210/220 |
| 6,511,602 | B1 | 1/2003 | Miyashita et al. | |
| 6,555,005 | B1 | 4/2003 | Zha et al. | |
| 7,022,236 | B2 * | 4/2006 | Liu et al. | 210/620 |
| 7,622,040 | B2 * | 11/2009 | Mitchell et al. | 210/242.2 |
| 7,744,069 | B2 * | 6/2010 | Hoefken | 261/122.1 |
| 7,850,151 | B2 * | 12/2010 | Kim et al. | 261/124 |
| 2005/0151281 | A1 * | 7/2005 | Tharp | 261/122.1 |
| 2008/0087609 | A1 * | 4/2008 | Naess et al. | 210/744 |
| 2010/0224556 | A1 | 9/2010 | Liao et al. | |
| 2011/0049038 | A1 | 3/2011 | Aerts et al. | |

FOREIGN PATENT DOCUMENTS

CN 101893164 11/2010

OTHER PUBLICATIONS

U.S. Appl. No. 61/526,539, filed Aug. 2011.

* cited by examiner

*Primary Examiner* — Charles Bushey
(74) *Attorney, Agent, or Firm* — Edward W. Black

(57) ABSTRACT

A gas diffuser including a grid of aeration pipes spaced apart and in parallel alignment within a horizontal plane is provided. The aeration pipes have improved discharge hole placement along their lengths and around their circumferences to provide improved performance and reduced fouling of membrane filtration systems associated therewith.

6 Claims, 1 Drawing Sheet

GAS DIFFUSER

FIELD

The present invention is directed toward gas diffusers, and particularly those adapted for use with or as part of a submergible membrane filtration system.

INTRODUCTION

The performance of pressure driven, membrane-based filtration systems can be significantly degraded by the accumulation of debris upon the membrane surface. This phenomenon is commonly referred to as "fouling." In order to mitigate fouling, many submergible membrane filtration systems include gas diffusers (also referred to as "gas spargers" or "aerators") located beneath the membranes. In operation, gas (e.g. air) bubbles are dispensed from the diffuser and travel upward, scrubbing the membranes surfaces as they rise. Examples of such systems are described in: U.S. Pat. No. 5,248,424, U.S. Pat. No. 5,482,625, U.S. Pat. No. 6,511,602, U.S. Pat. No. 6,555,005, US 2010/0224556, US 2011/0049038, US 61/526,539, CN 101893164. As the generation of bubbles is energy intensive, more efficient gas diffuser designs are desired.

SUMMARY

The present invention includes an improved gas diffuser wherein the gas flow rates associated with various discharge holes is relatively uniform, including holes having different hydrodynamic diameters located at different positions about an aeration pipe. In a preferred embodiment, the gas diffuser comprises a grid of aeration pipes spaced apart and in parallel alignment with each other within a common horizontal plane and a manifold in fluid communication with the aeration pipes. A given aeration pipe (12) includes: a length (L) extending between two ends and defining an axis (Z), a hydrodynamic diameter ($D_h$), an elliptical cross-sectional area defining a vertical plane comprising a vertical (Y) and horizontal (X) axis intersecting through a center (C) which are perpendicular to axis (Z), an outer circumference defined by a first arc (20) comprising 30° located below the (X) axis and bisected by the (Y) axis, and a second arc (22) comprising 330° which is non-overlapping with the first arc (20. A plurality (N) of discharge holes are spaced along the length (L) at four or more distinct positions about the second arc within the sectors and a plurality (M) of drainage holes spaced along the length (L) within the first arc;

The second arc includes four non-overlapping 15° sectors, each comprising:

i) at least 10 discharge holes having a minimum hydraulic diameter ($d_{min}$) of equal to or greater than 0.001 m, ii) a value (y) equal to the average position along the Y axis of all discharge holes within the sector measured in meters, and iii) a value (F) equal to the mean value of the hydraulic diameter (d) to the fourth power for all discharge holes within the sector measured in meters;

wherein the following relationship applies for any two of the four sectors:

$$\mathrm{Abs}[1-F_i/F_{ii}+2.60\times10^{8}\mathrm{m}^{-5}N^{2}(y_{ii}-y_i)F_i)]\leq0.5$$

wherein "i" and "ii" refer to higher and lower sectors along the Y axis, respectively

DETAILED DESCRIPTION

The present invention includes multiple embodiments including both a gas diffuser and submergible membrane filtration systems incorporating the same. The submergible membrane filtration system is not particularly limited and includes both hollow fiber and flat membrane sheet configurations as described in the patent documents cited in the Introduction.

Figure 1:
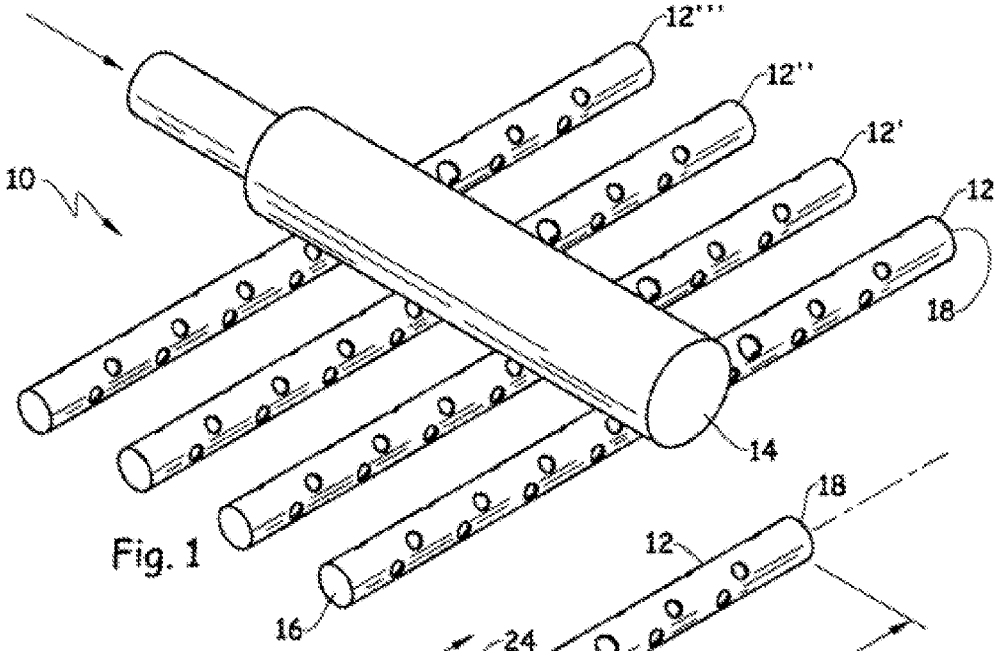
FIG. 1 is a perspective view of a gas diffuser including a manifold in fluid communication with a grid of aeration pipes.
Figure 2:
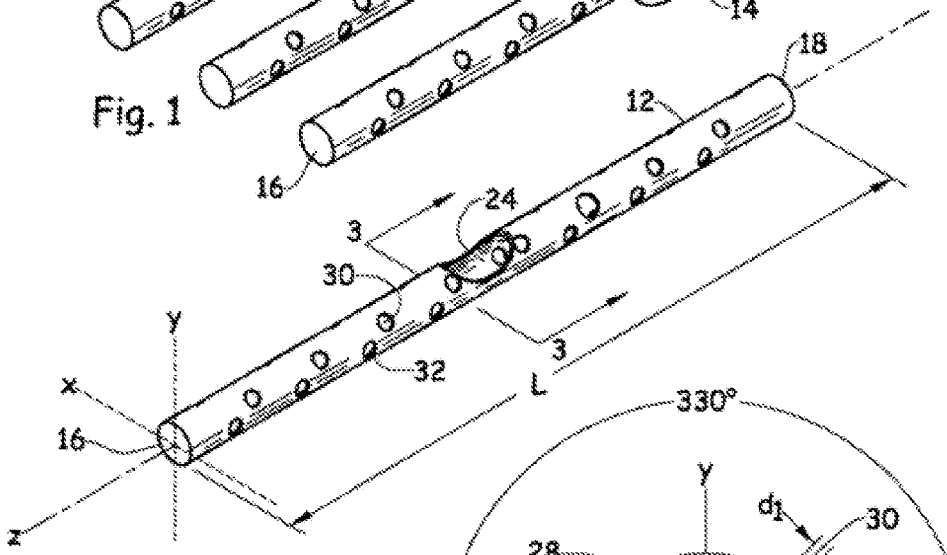
FIG. 2 is perspective view of an aeration pipe of FIG. 1.
Figure 3:
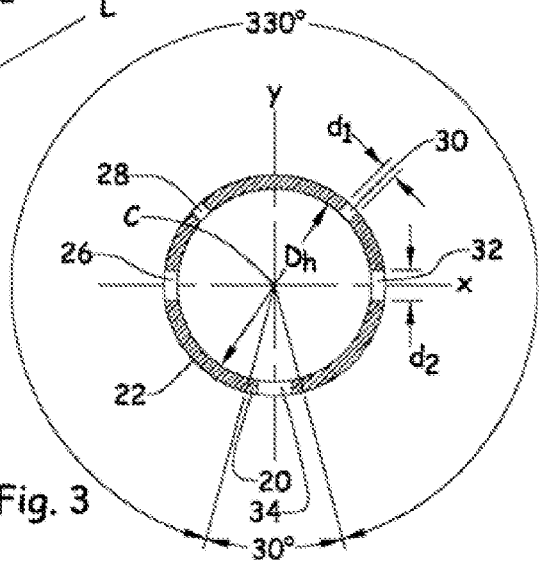
FIG. 3 is a cross-sectional view of the aeration pipe of FIG. 2 taken along lines 3-3.

With reference to the Figures, an embodiment of a gas diffuser is generally shown at (10) in FIG. 1, including a grid of aeration pipes (12, 12', 12", 12''') spaced apart and in parallel alignment with each within a common horizontal plane and a header or "manifold" (14) in fluid communication with the aeration pipes. While not particularly limited the number of aeration pipes per manifold is preferably from 2 to 24. The materials of construction are not particularly limited and include metal (e.g. steel, aluminum, etc.) and plastic (e.g. polyvinyl chloride, polypropylene, polyethylene, etc.). The aeration pipes and manifold may be interconnected with welds and glues as is common in the art.

An individual aeration pipe (12) has a length (L) of preferably from 0.5 to 3 meters extending between two ends (16, 18) and which defines an axis (Z). The pipe (12) has an elliptical cross-sectional area defining a vertical plane comprising a vertical (Y) and horizontal (X) axis intersecting through a center (C) which are perpendicular to axis (Z). While shown as having a circular cross-section, the aeration pipe (12) may have alternative elliptical cross-sections. For purposes of description, the term "hydrodynamic diameter" is defined as 4A/P wherein "A" is the cross sectional area and "P" is the wetted perimeter of the cross-section. Thus, for aeration pipes (12) including circular cross sections, the hydrodynamic diameter ($D_h$) simply refers to the inner diameter of the pipe (12). While not limited, the hydrodynamic diameter ($D_h$) of the aeration pipe (12) is preferably from 0.010 to 0.050 m. The ends (16, 18) of the aeration pipes are preferably sealed. And in preferred embodiments, the aeration pipes (12, 12', 12", 12''') have substantially the same lengths (L) and hydrodynamic diameters ($D_h$).

The pipe (12) further includes an outer circumference defined by a first arc (20) comprising 30° located below the (X) axis and bisected by the (Y) axis and a second arc (22) of 330° subdivided into 22 equal sized, non-overlapping 15° sectors—four of which are referenced below in connection with an embodiment of the invention. The first (20) and second (22) arcs are non-overlapping.

In the embodiment shown in FIG. 1, the manifold (14) is centrally located between the ends of the aeration pipes (12, 12', 12", 12''') and extends in a perpendicular direction, i.e. along horizontal axis (Y) either just above or below the common horizontal plane defined by the grid of aeration pipes. The manifold (14) is in fluid communication with each aeration pipe by way of a gas inlet (24). While not shown, the manifold may alternatively be located at one end (16) or both ends (16, 18) of the aeration pipes (12, 12', 12", 12''').

An aeration pipe (12) includes a plurality (N) of discharge holes (26, 28, 30, 32) spaced along the length (L) at four or more distinct positions about the second arc (22) and a plurality (M) of drainage holes (34) spaced along the length (L) within the first arc (20). The holes are preferably elliptical, e.g. circular, but other shapes may be utilized, e.g. polygonal.

The number (N, M) of discharge and drainage holes is not particularly limited but N is preferably from 10 to 100 and M is preferably from 2 to 20. Holes having hydrodynamic diameters of less than 1 mm are disregarded for purposes of the description. In a preferred embodiment, the discharge and drainage holes have the following characteristics:

i) a minimum hydrodynamic diameter ($d_{min}$) of equal to or greater than 0.001 m, ii) a median hydrodynamic diameter ($d_{med}$) from 0.001 to 0.01 m and more preferably 0.002 to 0.005 m, and iii) a maximum hydrodynamic diameter ($d_{max}$) equal to or less than 0.01 mm.

Moreover, the ratio of the cross-sectional area of the aeration pipe (12) to the total cross-sectional area of:

iv) all the discharge holes (24, 26, 28, 30) is greater than 1, and preferably greater than 1.2, and v) all the drainage holes is less than 1, and more preferably less than 0.5.

In a preferred embodiment, a plurality (N) of discharge holes (26, 28, 30, 32) located about the second arc (22) within four non-overlapping 15° sectors, wherein each of the four sectors comprise:

vi) at least 10 discharge holes having a minimum hydrodynamic diameter ($d_{min}$) of equal to or greater than 0.001 m, vii) a value (y) equal to the average position along the Y axis of all discharge holes within the sector measured in meters, and viii) a value (F) equal to the mean value of the hydraulic diameter (d) to the forth power for all discharge holes within the sector measured in meters;

wherein the following relationship applies for any two the four sectors:

$$\mathrm{Abs}[1-F_i/F_{ii}+2.6\times10^8\mathrm{m}^{-5}N^2(y_{ii}-y_i)F_i)]\leq0.5$$

wherein "i" and "ii" refer to higher and lower sectors along the Y axis, respectively.

In another preferred embodiment, the gas diffuser further conforms to the following:

$$N^2\mathrm{Abs}(0.5-0.025(L/D_h))(d_{max}/D_h)^4\leq0.3$$

In operation, pressurized gas, e.g. air, is introduced into the manifold (14) (represented by the arrow in FIG. 1) such as by way of a gas compressor and is distributed to the aeration pipes (12, 12', 12", 12''') by way of gas inlets (24). Due to the size and spacing of the discharge (26, 28, 30, 32) and drainage (34) holes, the subject gas diffuser (10) provides improved gas flow distribution such that gas flow rates of individual discharge holes varies by less than 20% from the median gas flow rate of all discharge holes within an aeration pipe during operation, and more preferably less than 10%. In preferred embodiments, such gas flow rates vary by less than 20% and even 10% from the median gas flow rate of all discharge holes with the gas distributor. Such uniform gas distribution among discharge holes, regardless of their size and location on the Y axis, results in more efficient and effective operation.

Many embodiments of the invention have been described and in some instances certain embodiments, selections, ranges, constituents, or other features have been characterized as being "preferred." Characterizations of "preferred" features should in no way be interpreted as deeming such features as being required, essential or critical to the invention. Stated ranges include end points. The entire subject matter of each of the aforementioned patent documents is incorporated herein by reference.

The invention claimed is:

1. A gas diffuser (10) comprising a grid of aeration pipes (12, 12', 12", 12''') spaced apart and in parallel alignment with each other within a common horizontal plane and a manifold (14) in fluid communication with the aeration pipes, wherein an aeration pipe (12) comprises:

a length (L) extending between two ends (16, 18) and defining an axis (Z), a hydrodynamic diameter ($D_h$), an elliptical cross-sectional area defining a vertical plane comprising a vertical (Y) and horizontal (X) axis intersecting through a center (C) which are perpendicular to axis (Z), an outer circumference defined by a first arc (20) comprising 30° located below the (X) axis and bisected by the (Y) axis, and a second arc (22) comprising 330° which is non-overlapping with the first arc (20) and wherein the second arc (22) comprises four non-overlapping 15° sectors, a plurality (N) of discharge holes (26, 28, 30, 32) spaced along the length (L) at four or more distinct positions about the second arc (22) within said sectors and a plurality (M) of drainage holes (34) spaced along the length (L) within the first arc (20);

wherein each of the four sectors of the second arc (22) comprise:

at least 10 discharge holes having a minimum hydraulic diameter ($d_{min}$) of equal to or greater than 0.001 m, a value (y) equal to the average position along the Y axis of all discharge holes within the sector measured in meters, and a value (F) equal to the mean value of the hydraulic diameter (d) to the fourth power for all discharge holes within the sector measured in meters;

wherein the following relationship applies for any two of the four sectors:

$$\mathrm{Abs}[1-F_i/F_{ii}+2.6\times10^8\mathrm{m}^{-5}N^2(y_{ii}-y_i)F_i)]\leq0.5$$

wherein "i" and "ii" refer to higher and lower sectors along the Y axis, respectively.

2. The gas diffuser of claim 1 wherein the ratio of the cross-sectional area of the aeration pipe (12) to the total cross-sectional area of all the discharge holes (26, 28, 30, 32) is greater than 1.

3. The gas diffuser of claim 1 wherein the ratio of the cross-sectional area of the aeration pipe (12) to the total cross-sectional area of all the drainage holes (34) is less than 1.

4. The gas diffuser of claim 1 wherein all discharge holes (26, 28, 30, 32) have a hydraulic diameter (d) greater than or equal to 0.001 m and less than or equal to 0.01 m.

5. The gas diffuser of claim 1 wherein all drainage holes (34) have a hydraulic diameter (d) greater than or equal to 0.001 m and less than or equal to 0.01 m.

6. The gas diffuser of claim 1 wherein the discharge holes have a minimum hydraulic diameter ($d_{min}$) and a maximum hydraulic diameter ($d_{max}$) and the ratio of $d_{max}$ to $d_{min}$ is less than 2.

* * * * *